US005422667A

United States Patent [19]

Daggs et al.

[11] Patent Number: 5,422,667

[45] Date of Patent: Jun. 6, 1995

[54] INK JET PRINTING CARTRIDGE WITH CIRCUIT ELEMENT PROTECTION SYSTEM

[75] Inventors: Robert W. Daggs, Simi Valley; Donald C. Ulry, Thousand Oaks; Mark L. Drake, both of South Pasadena, all of Calif.

[73] Assignee: General Ribbon Corporation, Chatsworth, Calif.

[21] Appl. No.: 984,901

[22] Filed: Dec. 2, 1992

[51] Int. Cl.[6] ..... B41J 2/175

[52] U.S. Cl. ..... 347/87; 347/50

[58] Field of Search ..... 346/1.1, 75, 140 R; 220/359; 347/49, 50, 58, 87

[56] References Cited

U.S. PATENT DOCUMENTS

| | | | |
|---|---|---|---|
| 4,896,788 | 1/1990 | Bolte et al. | 220/359 |
| 4,907,018 | 3/1990 | Pinkerpell et al. | 347/50 |
| 5,291,226 | 3/1994 | Schantz et al. | 347/63 |

*Primary Examiner*—Benjamin R. Fuller
*Assistant Examiner*—John Barlow
*Attorney, Agent, or Firm*—Baker, Maxham, Jester & Meador

[57] ABSTRACT

In an ink jet cartridge the platform structure is formed in part by an extension of the bottom of the housing and a forward platform surface intersecting the extension and extending generally perpendicularly thereto. A discharge plate is formed on the platform surface. The discharge plate has one or more rows of ink discharge ports in fluid communication with the ink reservoir. A ink propulsion element is arranged on each of the ink discharge ports. A carrier strip is mounted on the housing. The strip has a forward portion mounted over the platform surface, a rearward portion mounted over the bottom of the housing, and a central portion extending over the intersection of the housing top and the platform surface. A plurality of electrodes are formed on the rearward portion of the carrier strip in an electrode pattern. A plurality of electrically conductive paths are formed on the carrier strip. Each conductive path has a forward end in electrical contact with one of the ink propulsion elements and a rearward end in electrical contact with one of the electrodes. A layer of electrically insulating, heat dissipating, corrosion and oxidation resistant sealant material is injected, placed or otherwise formed between the housing and the carrier strip where exposed. The layer extends beneath the carrier strip from a forward location overlying the platform surface to a rearward location overlying the bottom of the housing, and may include other areas of exposed conductors as well.

13 Claims, 1 Drawing Sheet

INK JET PRINTING CARTRIDGE WITH CIRCUIT ELEMENT PROTECTION SYSTEM

BACKGROUND OF THE INVENTION

The present invention relates generally to printing, and more particularly to ink jet printing, wherein images are formed on a print medium by propelling droplets of ink toward the medium in a controlled fashion. Still more particularly, the invention pertains to an improved ink jet printing cartridge for use in an ink jet printing device.

Ink jet printers has proven useful for reducing computer generated text and graphics images to printed form. They produce images having higher quality than dot matrix printers and are generally faster. At the heart of the ink jet printer is a cartridge, known in the art as an "ink jet cartridge", that contains a reservoir of ink and an electro-mechanical system for propelling the ink toward a print medium in a controlled fashion. The electro-mechanical system typically includes a discharge plate located at one end of the ink reservoir having one or more vertical rows of very small ink discharge ports therein in fluid communication with the ink reservoir. At each discharge port there is placed an ink propulsion element such as a piezoelectric pump or a conductive heating element. Each propulsion element is connected to a conductive path element formed on a carrier strip that is mounted on an outside surface of the ink reservoir. The carrier strip has a plurality of conductive circuit paths formed thereon, much like a printed circuit board except that the carrier strip may be flexible. Each circuit path extends from a single ink propulsion element of the discharge plate to an electrical contact.

When the ink jet cartridge is properly positioned in the printer, the electrical contacts engage corresponding output pins in the printer. Images are formed by providing electrical signals to selected combinations of the output pins of the printer. These signals are in turned carried to the associated ink propulsion elements at the ink discharge ports. The activated ink propulsion elements exert or generate a force, e.g. by heating, that causes the ink drops to spray toward the medium in a predetermined pattern. By selective activation of the printer output pins, numerous ink patterns can be formed on the medium.

As ink jet cartridges age, the quality of the images they produce can deteriorate. After prolonged use, one or more conductive elements may cease functioning, such that no ink is expelled from the corresponding ink discharge ports. When this condition occurs, gaps appear in the generated image. This problem has been aggravated in recent years as a result of recycling efforts wherein spent ink cartridges are refilled with ink for continued use, thus extending the active life of the cartridge.

It would be desirable, therefore, to provide an improved ink jet cartridge whose image producing capacity does not deteriorate over time or which deteriorates at a slower rate. In that way, the useful life of the cartridge could be extended to provide more service to the user and thus more of an incentive to recycle.

SUMMARY OF THE INVENTION

In accordance with the foregoing objectives and advantages, there is provided an improved ink jet cartridge having a novel circuit element protection feature.

The cartridge includes a housing having a forward end, a rearward end, a top, a bottom, and a pair of sides extending between the top and bottom and the forward and rearward ends. The housing provides an ink reservoir for containing a quantity of ink. A reservoir cap is mounted on the rearward end of the housing providing a cover for the ink reservoir. An ink discharge platform structure extends forwardly of the forward end of the housing. The platform structure is formed in part by an extension of the top of the housing, and a forward platform surface intersecting the extension and extending generally perpendicularly thereto. A discharge plate is formed on the platform surface. The discharge plate has one or more rows of ink discharge ports in fluid communication with the ink reservoir. An ink propulsion element is arranged in association with each of the ink discharge ports.

A carrier strip is mounted on the housing. The carrier strip has a forward portion mounted over the platform surface, a rearward portion mounted over the bottom of the housing, and a central portion extending over the intersection of the housing bottom and the forward platform surface. A plurality of electrodes are formed on the rearward portion of the carrier strip in an electrode pattern. A plurality of electrically conductive paths are also formed on the carrier strip. Each conductive path has a forward end in electrical contact with one of the ink propulsion elements and a rearward end in electrical contact with one of the electrodes. A layer of electrically insulating, heat dissipating, corrosion and oxidation resistant sealant material is injected or otherwise placed or formed between the housing and the carrier strip wherever direct contact between the housing and the carrier strip is not complete. Thus, the layer preferably extends beneath the carrier strip at a location overlying the intersection of the housing bottom and the forward platform surface, and at other locations where one or more of the electrically conductive paths are exposed to air and possibly ink or other moisture.

BRIEF DESCRIPTION OF THE DRAWINGS

The objects, advantages and features of the present invention will be more clearly understood by reference to the following detailed disclosure and the accompanying drawing in which.

DETAILED DESCRIPTION OF THE PREFERRED EMBODIMENTS

Figure 1:
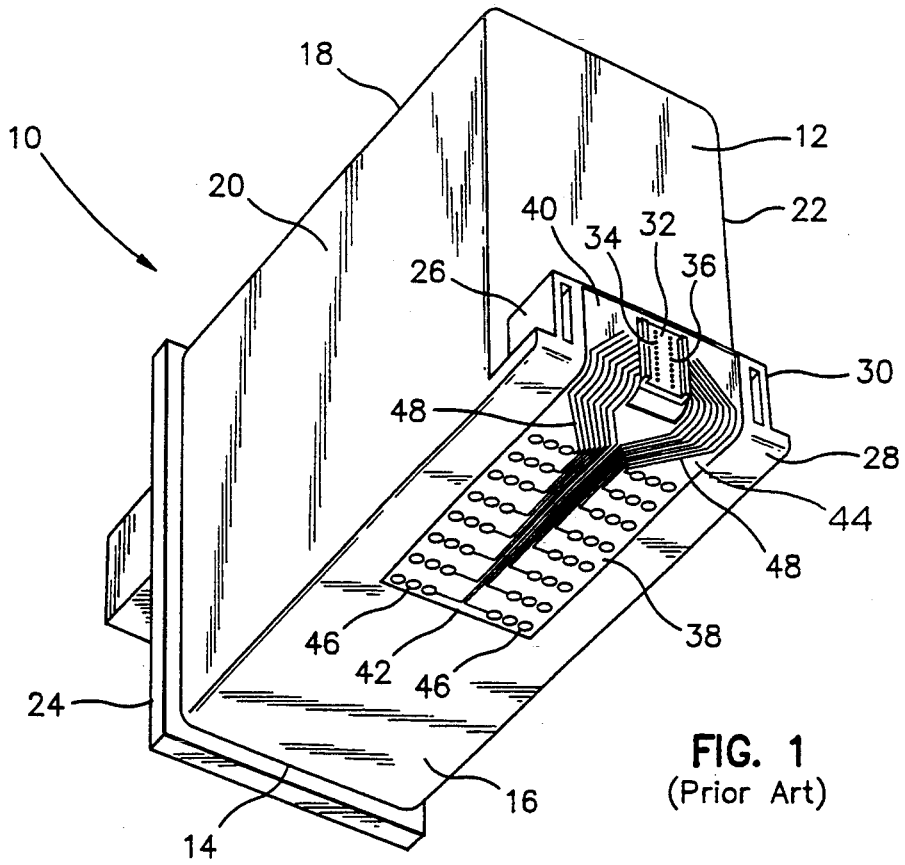
FIG. 1 (Prior Art)
FIG. 1 is a prior art ink jet cartridge.

Referring now to the FIG. 1, a prior art cartridge includes a housing 10 having a forward end 12 , a rearward end 14, a bottom 16, a top 18 , and a pair of sides 20 and 22 extending between the top and bottom and the forward and rearward ends. The housing 10 provides an ink reservoir for containing a quantity of ink. A reservoir cap 24 is mounted on the rearward end of the housing providing a cover for the ink reservoir. An ink discharge platform structure 26 extends forwardly of the forward end 12 of the housing 10. The platform structure 26 is formed in part by an extension 28 of the bottom 16 of the housing and a forward platform surface 30 intersecting the extension 28 and extending generally perpendicularly thereto. A discharge plate 32 is formed on the platform surface 30. The discharge plate 32 has one or more rows of ink discharge ports 34 and 36 in fluid communication with the ink reservoir. An ink propulsion element is arranged in association each of the ink discharge ports 34 and 36, as is conventionally known.

A carrier strip 38 is mounted on the housing 10. This strip can be made from a variety of flexible or non-flexible materials including an insulative sheet product sold by Dupont Corporation under the name KAPTON. The carrier strip has a forward portion 40 mounted over the platform surface 30, a rearward portion 42 mounted over the bottom 16 of the housing, and a central portion 44 extending over the intersection of the housing bottom 16 and the platform surface 30. A plurality of electrodes 46 are formed adjacent the rearward portion 42 of the carrier strip 38 in an organized pattern. A plurality of electrically conductive paths 48 are also formed on the carrier strip. Each conductive path 48 has a forward end in electrical contact with one of the ink propulsion elements and a rearward end in electrical contact with one of the electrodes 46.

In the prior art ink jet cartridges of FIG. 1, Applicant has observed a tendency for electrical failures to arise as the cartridges age. These electrical failures degrade cartridge performance because the printer is unable to energize all of the cartridge ink propulsion elements located at the ink discharge ports. Through observation and experimentation, Applicant has confirmed that the problem of electrical failure in conventional ink jet cartridges can be greatly minimized by introducing between the top 16 of the housing 10 and the carrier strip 38, a layer of sealant having heat dissipating, corrosion and oxidation resistant properties.

Figure 2:
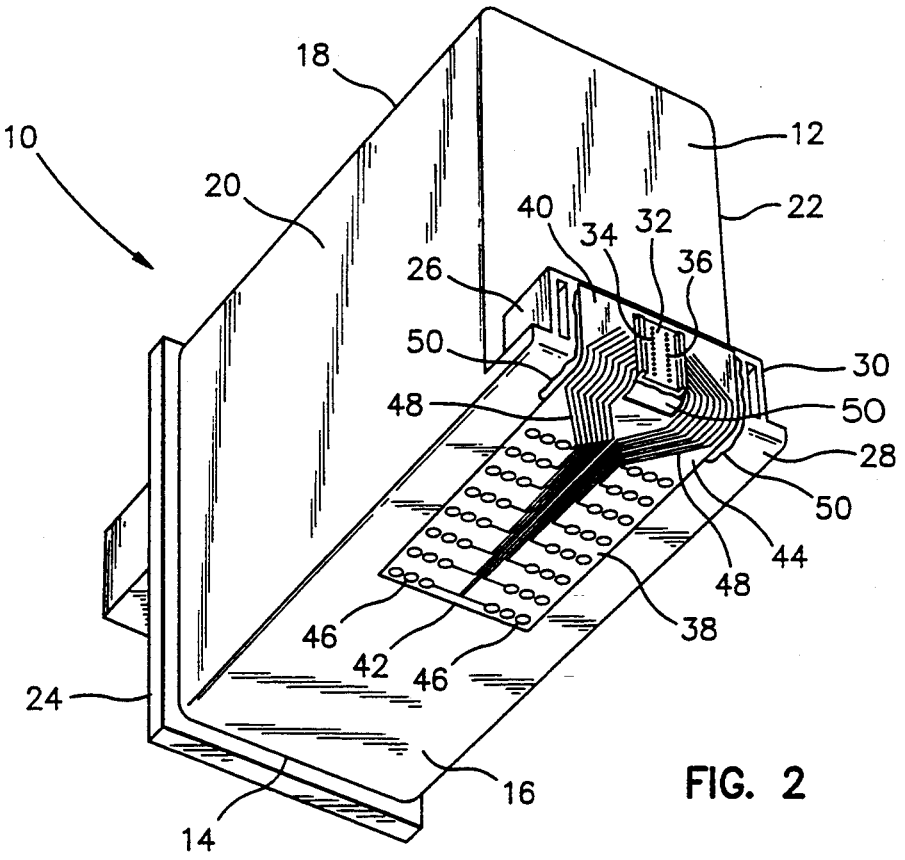
FIG. 2 is an improved ink jet cartridge constructed in accordance with the invention and including a circuit element protection system.

As shown in FIG. 2 an improved ink jet cartridge is formed by providing a layer 50 of electrically insulating, heat dissipating, corrosion and oxidation resistant sealant beneath the carrier strip 38. The sealant layer 50 preferably extends from a forward location overlying the platform surface 30 to a rearward location overlying the bottom 16 of the housing. In particular, the sealant layer should extend over the intersection of the housing extension 28 and the platform surface 30, and anywhere else the carrier strip 38 is not flush against the housing 10. In these areas, there are typically air gaps and other voids and cavities between the conductive paths 48 and the housing 10. These air gaps insulate the exposed conductor paths and thus cause localized conductor overheating. The sealant layer 50 should thus be formed to extend forwardly around the perimeter of the discharge plate 32 and rearwardly to the electrodes 46, where most of the air gaps are commonly found. Applicant believes that the introduction of the sealant 50 in the air gaps between the carrier strip 38 and the housing 10 has proven successful due to the fact that the sealant provides a heat transfer path between the exposed conductive path on the carrier strip and the housing. The sealant also insulates and protects the conductive paths against ink and other moisture which can corrode and oxidize the conductive material.

In a preferred aspect of the invention, the sealant layer 50 is added to the ink jet cartridge as part of a refilling/recycling method. In a first step, a quantity of fluidized sealant material capable of being discharged from a syringe-like device is selected. Suitable insulative materials include members of the silicon family. A preferred material is silicon rubber, although many other materials, such as epoxy resins, or ultraviolet curable resins (as discussed in more detail below), could also be used. The quantity of sealant material selected depends on the extent of any cavities, voids and gaps between the carrier strip 38 and the housing 10. The sealant material is placed in a syringe or syringe-like device and injected wherever possible between the carrier strip 38 and the top 16, and the forward platform surface 30, of the housing 10. As indicated, the sealant layer will extend in most cases from a forward location around the periphery of the discharge plate to a rearward location adjacent the electrodes. For sealant materials in the silicon family, the injection process is preferably conducted at a room temperature of about 70 degrees F. For other sealant materials injection temperature may differ. The sealant material should be injected so that it extends under all of the exposed conductive paths 48 of the carrier strip 38. In most eases, the thickness of the sealant layer will be around 0.002 to 0.040 inches. Following injection, the sealant layer 50 should be allowed to harden. For silicon sealant, the hardening period should be about four to twelve hours.

In an alternative aspect of the invention, the sealant layer 50 may be applied, by injection of other suitable sealant placement methods, as an ultraviolet curable resin. Such resins are known. They are available in liquid form and will cure to a hardened state upon exposure to a suitable ultraviolet light source. These resins are advantageous because, unlike epoxys, curing can be completed within minutes by selecting an appropriate lamp wattage and lamp placement distance from the curing site.

In a further aspect of the invention, the sealant layer 5 could be applied, preferably by injection, as a hot melt resin. Such resins are conventionally known. They are liquid at elevated temperatures but solid at room temperature. A conventional applicator having a heating element disposed therein can be used to inject or insert the hot melt at the appropriate locations on the housing 10.

In a still further aspect of the invention, the sealant layer could be applied by affixing a mask over the discharge plate 32 and dipping a portion of the housing forward end 12, and bottom 16, including portions of the carrier strip 38, into a liquid sealant material such as liquid nylon or other suitable electrically insulating, heat dissipating, corrosion and oxidation resistant compounds. Such compounds could also include the epoxys and ultraviolet curable resins described above. When the sealant has dried, the mask can be removed to expose the discharge plate for use. In still another embodiment, the sealants described above could be painted on appropriate portions of the cartridge instead of the cartridge being dipped in sealant.

Accordingly, a novel ink jet cartridge with circuit element protection has been disclosed. While various embodiments have been shown and described, many variations and alternative embodiments will be apparent to those skilled in the art in view of the teachings herein. It will be understood, therefore, that the invention is not to be in any way limited except in accordance with the spirit of the appended claims and their equivalents.

We claim:

1. In an ink jet cartridge having a housing providing an ink reservoir, an ink discharge platform including a discharge plate, and a carrier strip containing plural current carrying electrical paths between a plurality of electrodes mounted on said strip and a plurality of ink propulsion elements mounted on said discharge plate, said ink discharge platform and said carrier strip being mounted on said housing, a method for extending the service life of said cartridge comprising the steps of:

selecting a suitable quantity of a fluidized electrically insulating, heat dissipating, corrosion and heat resistant sealant material capable of being dispensed from a syringe-like device;

inserting said quantity of sealant material into a syringe-like device; and injecting said quantity of sealant material underneath said carrier strip at locations underlying said electrical paths.

2. The method of claim 1 wherein said sealant material is made from a member of the silicon family.

3. The method of claim 1 wherein said sealant material is made from silicon rubber.

4. The method of claim 1 wherein said sealant material is made from an ultraviolet curable resin.

5. The method of claim 1 wherein said sealant material is made from a hot melt resin.

6. The method of claim 1 wherein said sealant material is injected to extend forwardly around perimeter portions of said discharge plate.

7. The method of claim 1 wherein said sealant material is injected to extend rearwardly to said electrodes.

8. The method of claim 1 wherein said sealant material is injected to extend forwardly around perimeter portions of said discharge plate and rearwardly to said electrodes, to cover all exposed electrically conductive paths in said carrier strip.

9. A method for recycling an ink jet cartridge having a housing providing an ink reservoir, an ink discharge platform including a discharge plate, and a carrier strip containing plural current carrying electrical paths between a plurality of electrodes mounted on said strip and a plurality of ink propulsion elements mounted on said discharge plate, said ink discharge platform and said carrier strip being mounted on said housing, said method comprising the steps of:

placing a quantity of an electrically insulating, heat dissipating, corrosion and oxidation resistant sealant material between said carrier strip and said housing by affixing a mask to said discharge plate, covering a portion of said carrier strip and housing with said sealant in liquid form, and removing said mask when said sealant has dried.

10. In an ink jet cartridge having a housing providing an ink reservoir, an ink jet discharge platform including a discharge plate, and a carrier strip containing plural current to carrying electrical paths between a plurality of electrodes mounted on said strip in a plurality of ink propulsion elements mounted on said discharge plate, said ink discharge platform and said carrier stripping mounted on said housing, a method for extending service life of said cartridge comprising the steps of:

selecting a suitable quantity of sealant material; and placing said quantity of sealant material underneath of carrier strip at locations underlying said electrical paths, including the intersection of said ink reservoir bottom and said ink discharge platform.

11. The method of claim 10 wherein said sealant material is injected underneath of said carrier strip.

12. The method of claim 10 wherein said sealant material is placed underneath of carrier strip by dipping said carrier strip in a quantity of sealant material.

13. The method of claim 10 wherein said sealant material is sprayed underneath said carrier strip.

* * * * *